US009899742B2

(12) United States Patent
Liu et al.

(10) Patent No.: US 9,899,742 B2
(45) Date of Patent: Feb. 20, 2018

(54) ARTIFICIAL MICROSTRUCTURE AND ARTIFICIAL ELECTROMAGNETIC MATERIAL USING THE SAME

(75) Inventors: Ruopeng Liu, Shenzhen (CN); Guanxiong Xu, Shenzhen (CN); Jinjin Wang, Shenzhen (CN); Lin Luan, Shenzhen (CN); Zhiya Zhao, Shenzhen (CN); Chaofeng Kou, Shenzhen (CN); Fanglong He, Shenzhen (CN)

(73) Assignees: KUANG-CHI INNOVATIVE TECHNOLOGY LTD., Shenzhen (CN); KUANG-CHI INSTITUTE OF ADVANCED TECHNOLOGY, Shenzhen (CN)

( * ) Notice: Subject to any disclaimer, the term of this patent is extended or adjusted under 35 U.S.C. 154(b) by 427 days.

(21) Appl. No.: 13/577,553

(22) PCT Filed: Oct. 27, 2011

(86) PCT No.: PCT/CN2011/081367
§ 371 (c)(1),
(2), (4) Date: Aug. 7, 2012

(87) PCT Pub. No.: WO2012/122803
PCT Pub. Date: Sep. 20, 2012

(65) Prior Publication Data

US 2014/0011002 A1 Jan. 9, 2014

(30) Foreign Application Priority Data

Mar. 15, 2011 (CN) ..... 2011 1 0061804
Mar. 23, 2011 (CN) ..... 2011 1 0070889
(Continued)

(51) Int. Cl.
*H01Q 15/02* (2006.01)
*H01Q 15/24* (2006.01)
*H01Q 15/00* (2006.01)

(52) U.S. Cl.
CPC ..... *H01Q 15/02* (2013.01); *H01Q 15/0086* (2013.01); *H01Q 15/24* (2013.01); *Y10T 428/24802* (2015.01)

(58) Field of Classification Search
CPC ..... H01Q 15/0086
See application file for complete search history.

(56) References Cited

U.S. PATENT DOCUMENTS 5,214,432 A 5/1993 Kasevich et al.
2010/0078203 A1 4/2010 Lier
2010/0264524 A1 10/2010 Song et al.

FOREIGN PATENT DOCUMENTS

CN 1866612 A 11/2006
CN 101325274 A 12/2008
(Continued)

OTHER PUBLICATIONS

"Artificial Negative Permeability Based on a Fractal Jerusalem Cross," Katko, 2009, Undergraduate Honors Thesis, The Ohio State University.*

(Continued)

*Primary Examiner* — Ian Rummel
(74) *Attorney, Agent, or Firm* — Leason Ellis LLP

(57) ABSTRACT

An artificial microstructure used in artificial electromagnetic material includes a first line segment and a second line segment. The second line segment is perpendicular to the first line segment. The first line segment and the second line segment intersect with each other to form a cross-type
(Continued)

structure. The present disclosure further relates to an artificial electromagnetic material using the artificial microstructure.

21 Claims, 19 Drawing Sheets

(30) Foreign Application Priority Data

May 10, 2011 (CN) ..... 2011 1 0120003
May 20, 2011 (CN) ..... 2011 1 0131817

(56) References Cited

FOREIGN PATENT DOCUMENTS

CN 101740862 A 6/2010
CN 101919109 A 12/2010

OTHER PUBLICATIONS

Plum et al., "Giant optical gyrotropy due to electromagnetic coupling," Applied Physical Letters 90, 223113, 2007.*
The Design Synthesis of Multiband Artificial Magnetic Conductors Using High Impedance Frequency Selective Surface, pp. 1-3, by Douglas J. Kern, <<IEEE Transactions on Antennas and Propagation>>, published on Jan. 10, 2005.
Left-handed Material Micro-structure Configuration Design Optimization, by Weikai Xu, pp. 6-9 and Figs 1.7, <<Chinese Dectoral Dissertations Full-text Database Engineering Science and Technology I>>, published on Sep. 30, 2010.
High Impedance Surface EBG Structure Antenna Application Research, by Yingying Gu, pp. 27-31 and Fig. 3.12, <<China Master's Theses Full-test Database Information Technology>>, published on Apr. 30, 2007.
Frequency Selective Surfaces Theory and Design, by Ben A. Munk, published on Apr. 26, 2000 by Wilev-Interscience Publication, pp. 27-28 and Fig. 202 and Group 1: the square spiral, p. 37 2.2.5 Square Spiral Element and Fig. 2.14.

* cited by examiner

ARTIFICIAL MICROSTRUCTURE AND ARTIFICIAL ELECTROMAGNETIC MATERIAL USING THE SAME

CROSS-REFERENCE TO RELATED PATENT APPLICATIONS

This is a U.S. National Phase Application under 35 U.S.C. § 371 of International Patent Application No. PCT/CN2011/081367, filed Oct. 27, 2011, and claims the priority of Chinese Patent Application Nos. 201110131817.9, filed May 20, 2011, 201110120003.5, May 10, 2011, 201110070889.7, Mar. 23, 2011 and 201110061804.9, filed Mar. 15, 2011 all of which are incorporated by reference herein.

FIELD OF THE INVENTION

The exemplary disclosure relates to electromagnetic field, and particularly, to an artificial microstructure and an artificial electromagnetic material using the same.

BACKGROUND OF THE INVENTION

Metamaterial is a new academic vocabulary of 21st century in physics in recent years, and is usually mentioned in scientific literatures. Three important characteristics of the metamaterial include: (1) Metamaterial is usually a composite with novel artificial structure; (2) Metamaterial has extraordinary physical properties (which generally do not exist in materials of the nature); (3) Property of the metamaterial is not generally determined by the intrinsic nature of the constituent material, but is mainly determined by the artificial structure.

Overall, metamaterial is a material based on artificial structure serving as basic unit, and based on spatial arrangement of the basic units in special way. And metamaterial is a new material having special electromagnetic effect. Property of the electromagnetic effect is characterized by its artificial structure. By orderly designing key physical scale of the material structure, limitations of some of the apparent laws of the nature can be overcame, thus obtaining extraordinary material nature beyond ordinary property inherent in the nature.

Metamaterial includes artificial structure, wherein the electromagnetic response of the artificial structure mainly depends on the topological feature and size of structural units.

Metamaterial further includes matrix material with artificial structures attached thereon. The matrix material is used to support the artificial structure, and can be any material different from the artificial structure.

The artificial structure and the matrix material overlap with each other spatially to generate an equivalent dielectric constant $\xi$ and a magnetic permeability $\mu$. The two physical parameters correspond to an electric field response of the material and magnetic response, respectively. Therefore, designing the artificial structure of the metamaterial is the most important part in the field of metamaterial. How to attain a metamaterial, and to further improve the electromagnetic properties of the existing magnetic material, thus replacing the existing magnetic material in actual applications have become a major problem in the development of modern technology.

Therefore, there is room for improvement within the art.

DISCLOSURE OF THE INVENTION

In accordance with one aspect of the disclosure, an artificial microstructure is disclosed. The artificial microstructure used in artificial electromagnetic material includes a first line segment and a second line segment. The second line segment is perpendicular to the first line segment. The first line segment and the second line segment intersect with each other to form a cross-type structure.

In one embodiment of the disclosure, the artificial microstructure includes a number of third segments, and distal ends of the first line segment and the second line segment are respectively connected to the third line segments.

In one embodiment of the disclosure, a distal end of the third line segment extends outward in a direction 45 degrees relative to the first line segment or the second line segment.

In one embodiment of the disclosure, the artificial microstructure includes a line segment group, the line segment group includes a number of fourth line segments, each of the third segments has a fourth line segment vertically connected to both ends thereof.

In one embodiment of the disclosure, the artificial microstructure comprises N line segment groups, each line segment of the N segment group is connected to a distal end of the line segment of the N−1 line segment group, and is perpendicular to the line segment of the N−1 segment group, wherein N represents an integer greater than 1.

In one embodiment of the disclosure, a distal end of the first line segment and a distal end of the second line segment each include a curve portion.

In one embodiment of the disclosure, the curve portion includes at least one circuitous curve.

In one embodiment of the disclosure, the circuitous curve of the curve portion is round angle, right angle, or acute angle.

In one embodiment of the disclosure, the artificial microstructure includes a plurality of third line segments, and the curve portion is connected to a corresponding third line segment.

In one embodiment of the disclosure, the first line segment and the second line segment intersect with each other to form four parts, each of the parts and a corresponding curve portion thereof form a spiral.

In one embodiment of the disclosure, two curve portions located at a same imaginary line of the first line segment or the second line segment are symmetric relative to each other.

In one embodiment of the disclosure, the spiral is rectangular spiral or triangular spiral.

In one embodiment of the disclosure, the first line segments and the second line segments of a number of artificial microstructures intersect with each other at an imaginary central point.

In one embodiment of the disclosure, each curve portion coincides with a neighboring curve portion if such curve portion rotates 360/M degrees about an imaginary point intersected by the first line segment and the segment and served as a rotation center, wherein M represents the number of curve portion.

In one embodiment of the disclosure, the artificial microstructure includes a sixth line segment, the sixth line segment is perpendicular to the first line segment and the second line segment, and the sixth line segment, the first line segment and the second line segment interest at a point.

In one embodiment of the disclosure, the artificial microstructure includes a number third line segments, a distal end of the first line segment and a distal end of the second line segment each are respectively connected to the third line segments.

In one embodiment of the disclosure, the artificial microstructure includes a line segment group, the line segment group includes a number of fourth line segments, each of the third segments has a fourth line segment vertically connected to both ends thereof.

In one embodiment of the disclosure, the artificial microstructure includes N line segment groups, each line segment of the N segment group is connected to a distal end of the line segment of the N−1 line segment group, and is perpendicular to the line segment of the N−1 segment group, wherein N represents an integer greater than 1.

In one embodiment of the disclosure, lengths of each line segment of the N segment group are equal to each other or different to each other.

In one embodiment of the disclosure, the artificial microstructures are mirror images of each other along an imaginary center axis.

In one embodiment of the disclosure, size of the artificial microstructure is equal to or less than one fifth of the wavelength of a corresponding electromagnetic wave, which the artificial microstructure generates a response to.

In accordance with another aspect of the disclosure, an artificial electromagnetic material is disclosed. The artificial electromagnetic material includes a substrate. The substrate includes a number of structural units. The artificial microstructure above is arranged in the corresponding structural unit.

Using the present disclosure, the metamaterial can reduce a volume of the artificial microstructure, and leads to a miniaturization of an electronic component or an electronic device. The artificial microstructure of the present disclosure can obviously increase the absolute value of a minus permeability of the metamaterial and satisfy some specific conditions to obtain the minus permeability.

In one embodiment of the disclosure, a size of the structural unit equal to or less than one tenth of the wavelength of the response electromagnetic.

In one embodiment of the disclosure, the substrate insulating material.

In one embodiment of the disclosure, dielectric constant and magnetic permeability of the artificial electromagnetic material is less than zero.

Artificial electromagnetic materials of the above embodiments are a new material with special electromagnetic effects. The artificial electromagnetic materials can replace the existing magnetic material, and can be applied to a variety of applications. For example, the artificial electromagnetic materials can be applied to electromagnetic wave propagation modulation materials and devices, such as smart antenna, angle zoom, or the modulation of the waveguide system applied to the electromagnetic mode, functional polarization modulation devices, microwave circuit, THz (terahertz), and optical application.

Other advantages and novel features of the present disclosure will become more apparent from the following detailed description of preferred embodiment when taken in conjunction with the accompanying drawings.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

To improve the electromagnetic characteristics of typical electromagnetic materials in the existing technology, the present disclosure provides an artificial electromagnetic material. The artificial electromagnetic material can be used to replace the existing electromagnetic material, and used in varied electromagnetic application system.

Figure 1:
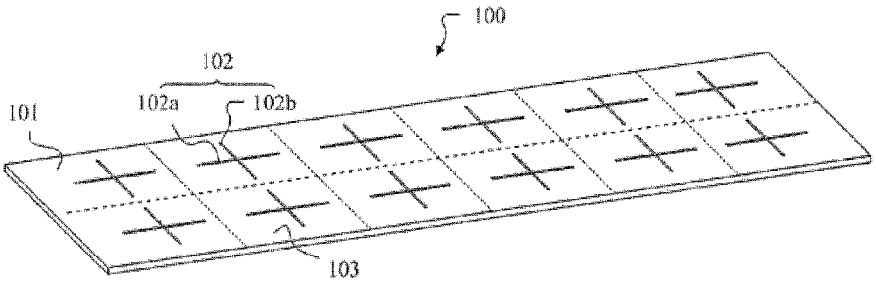
FIG. 1 is a schematic diagram of an artificial electromagnetic material according to a first embodiment.

Referring to FIG. 1, the first embodiment in the present disclosure relates to an artificial electromagnetic material 100. The artificial electromagnetic material 100 includes a substrate 101. The substrate 101 includes a number of structural units 103, as seen in region of FIG. 1, which are divided by dotted lines and verge of the substrate 101. The artificial electromagnetic material 100 in the present disclosure further includes a number of artificial microstructure 102. The artificial microstructures 102 are arranged in the structural units 103, respectively. In this embodiment, the substrate 101 is made of polytetrafluoroethylene (PTFE). In alternative embodiments, the substrate 101 is made of ceramics, or other insulating materials. Size of the structural units 103 and the artificial microstructure 102 can be adjusted if necessary. For example, when the artificial electromagnetic material needs to response to an electromagnetic wave with a wavelength λ, the size of the structural units 103 and the artificial microstructure 102 can be set to be less than one fifth of the wavelength λ. Preferably, in order to simplify the preparation process, magnitude of the size of the structure unit 103 and the artificial microstructures 102 can be one tenth of the wavelength λ. For example, in this embodiment, it is necessary to generate a special response to an electromagnetic wave with 3 cm wavelength, thus the size of the structural unit 103 and the artificial microstructure 102 is set to be between 1.5 mm~3 min, preferably 1.5 mm. The artificial microstructure 102 includes a first line segment 102*a* and a second line segment 102*b*, and the first line segment 102*a* and the second line segment 102*b* intersect with each other to form a cross-typed structure. The artificial microstructure 102 generally has structure, such as certain geometry plane or three-dimensional structure made from a metal wire. The metal wire can be copper or silver line having cylindrical section or flat section. The section of the metal wire may be other shapes. The artificial microstructure 102 can be attached to the structural units 103 by etching, plating, diamond engraving, lithography, e-engraving or ion engraving, or other forms of manufacturing method.

Figure 2:
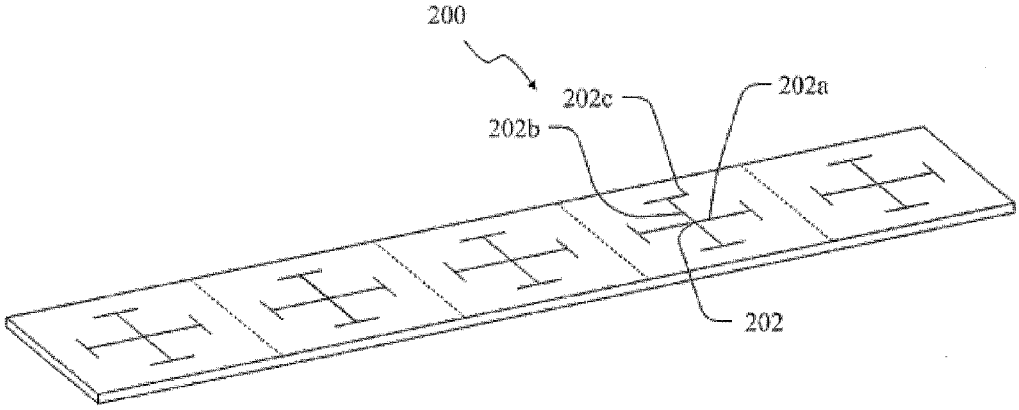
FIG. 2 is a schematic diagram of an artificial electromagnetic material according to a second embodiment.

FIG. 2 illustrates an artificial electromagnetic material 200 according to a second embodiment. The electromagnetic material 200 is similar to the electromagnetic materials 100. The electromagnetic material 200 includes a first line segment 202*a* and a second line segment 202*b*. However, the electromagnetic material 200 differs from the electromagnetic materials 100 in that the electromagnetic material 200 further includes a third line segment 202*c*. The third line segment 202*c* is connected to a distal end of the first line segment 202*a* and a distal end of the second line segment 202*b*. The first line segment 202*a* and the second line segment 202*b* are perpendicular bisector of the third line segment 202*c*.

Figure 3:
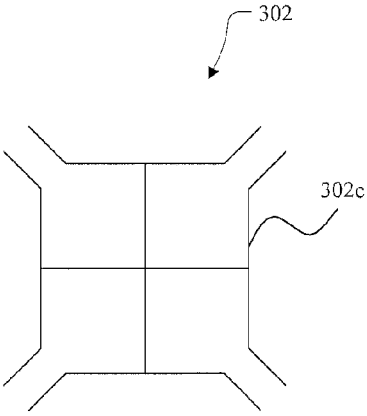
FIG. 3 is a schematic diagram of an artificial electromagnetic material according to a third embodiment.

FIG. 3 illustrates an artificial microstructure 302 according to a third embodiment. The artificial microstructure 302 is similar to the artificial microstructure 202. However, the artificial microstructure 302 differs from the artificial microstructure 202 in that two distal ends of the third line segment 302*c* extends outward in a direction 45 degrees (relative to the first line segment or the second line segment).

Figure 4:
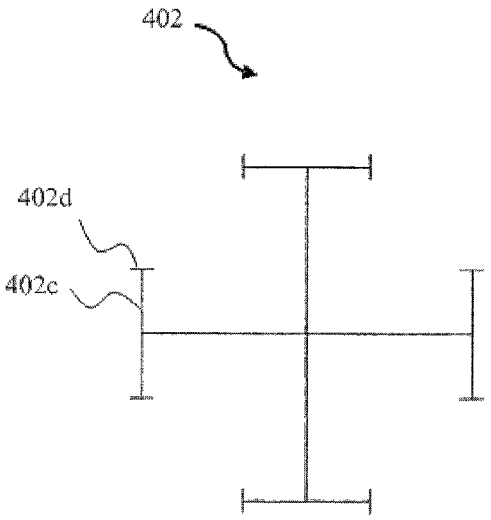
FIG. 4 is a schematic diagram of an artificial electromagnetic material according to a fourth embodiment.

FIG. 4 illustrates an artificial microstructure 402 according to a fourth embodiment. The artificial microstructure 402 is similar to the artificial microstructure 202. However, the artificial microstructure 402 differs from the artificial microstructure 202 in that the artificial microstructure 402 further includes a first line segment group, the first line segment group includes a number of fourth line segments 402*d*, two distal ends of the third line segment 402*c* are connected to the fourth line segment 402*d*. The fourth line segment 402*d* is perpendicular to the third line segment 402*c*.

Figure 5:
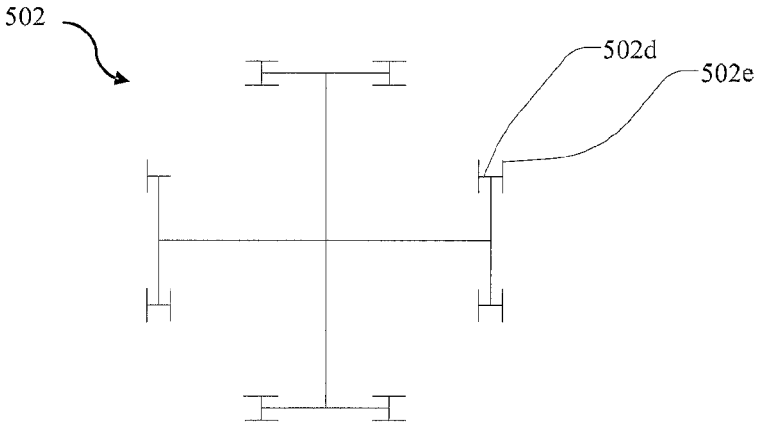
FIG. 5 is a schematic diagram of an artificial electromagnetic material according to a fifth embodiment.

FIG. 5 illustrates an artificial microstructure 502 according to a fifth embodiment. The artificial microstructure 502 is similar to the artificial microstructure 202. However, the artificial microstructure 502 differs from the artificial microstructure 402 in that the artificial microstructure 502 further includes a second line segment group. The second line segment group includes a number of fifth line segments 502*e*. Two distal ends of the fourth line segment 502*c* are connected to the fifth line segment 502*d*. The fifth line segment 502*e* is perpendicular to the fourth line segment 502*d*. Similarly, the artificial microstructure 502 may further includes a third line segment group. The structure of the third line segment group is in a manner same to the second line segment group. That is, each line segment of the third line segment group is connected between the fifth line segments 502*e* and perpendicular to the fifth line segments 502*e*, etc. When the artificial microstructure 502 includes N line segment groups, each line segment of the N segment group is connected to a distal end of the line segment of the N−1 line segment group, and is perpendicular to the line segment of the N−1 segment group, wherein N represents an integer greater than 1. These artificial microstructures are all derivative structures from 2D snowflake-shaped artificial microstructures.

Using the artificial microstructures as shown in FIG. 2-5, a quick and stable response on the two-dimensional electric field in a plane can be achieved, two pairs of the third line segments on the horizontal direction and the vertical direction form superposition of equivalent capacitance respectively, such that the metamaterial overall has high dielectric constant.

Figure 6:
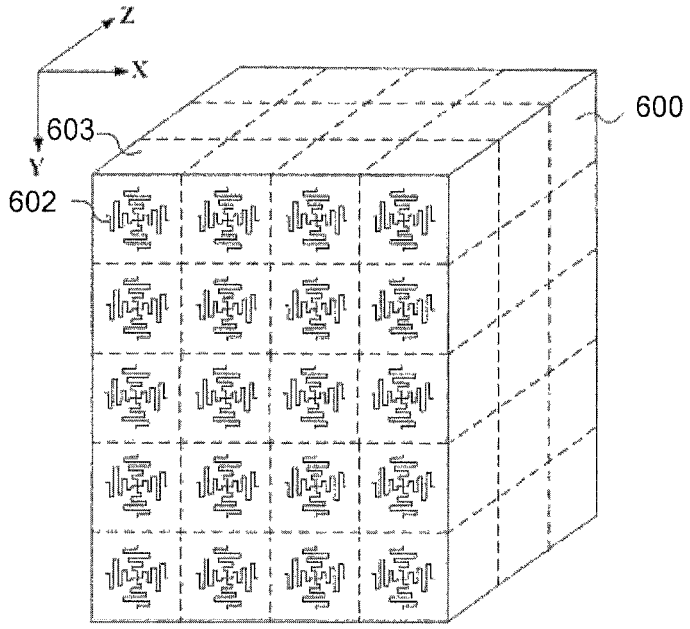
FIGS. 6-7 are schematic diagrams of an artificial electromagnetic material according to a sixth embodiment.
Figure 7:
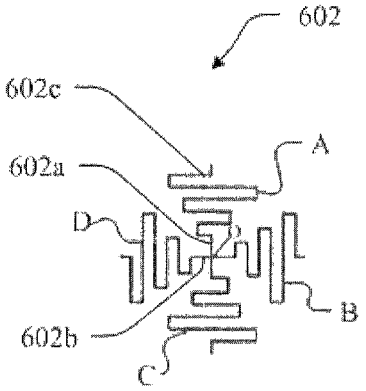

FIG. 6 and FIG. 7 illustrate an artificial electromagnetic material 600 according to a sixth embodiment. In this embodiment, a number of artificial electromagnetic materials 600 are stacked in sequence along a direction perpendicular to the artificial electromagnetic materials 600 plane (z axis direction). The artificial electromagnetic material 600 are assembled or attached together by filling material, such as liquid substrate adhesive between each two neighboring artificial electromagnetic materials 600. The artificial electromagnetic materials 600 can be connected to each other, when the adhesive becomes solid, and thus the artificial electromagnetic materials 600 are integrated to form a whole. The artificial electromagnetic material 600 can be ceramic material made of FR-4, F4b, CEM1, CEM3, or TP-1 with high dielectric constant.

The structural units 603 of the artificial electromagnetic material 600 are arrayed in row (x axis direction) and column (y axis direction perpendicular to the x axis direction). The structural units 603 each include an artificial microstructure 602.

The first line segment 602*a* and the second line segment 602*b* of the artificial microstructure 602 intersect at point O. The first line segment 602*a* and the second line segment 602*b* can be divided into four branches A, B, C and D. One end of each branch A, B, C or D is connected to the point O, and the other end is a free end. Each free end includes a curve portion 602*c*. Each curve portion 602*c* includes at least one circuitous curve. In this embodiment, the curve portion of the circuitous curve is a right angle. Any branch A, B, C or D coincides with another corresponding branch if it rotates 90, 180, and 270 degrees about point O.

Figure 8:
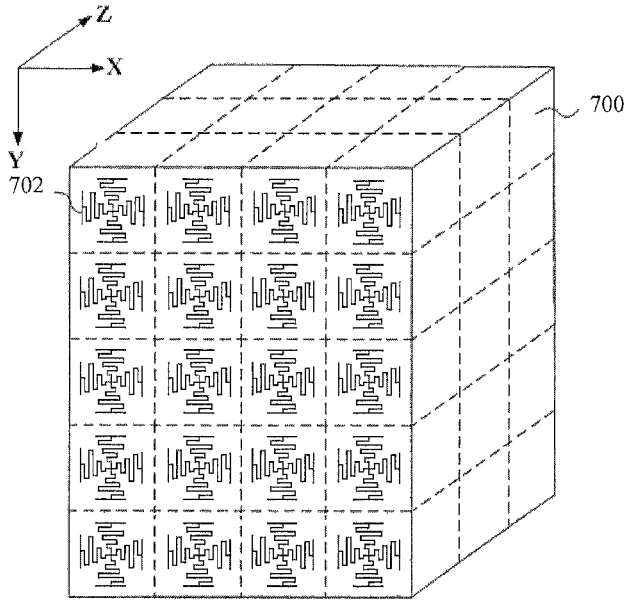
FIGS. 8-9 are schematic diagrams of an artificial electromagnetic material according to a seventh embodiment.
Figure 9:
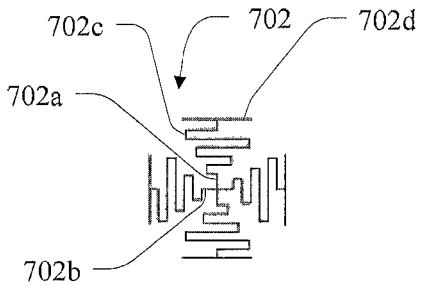

As shown in FIGS. 8 and 9, the artificial electromagnetic material 700 in this embodiment differs from the artificial electromagnetic materials 600 shown in FIG. 6 and FIG. 7 in that each curve portion 702*c* of the artificial microstructure 702*c* is connected to a third line segment 702*d*, and the curve portion 702*c* is connected to a middle of the third line segment 702*d*.

Figure 10:
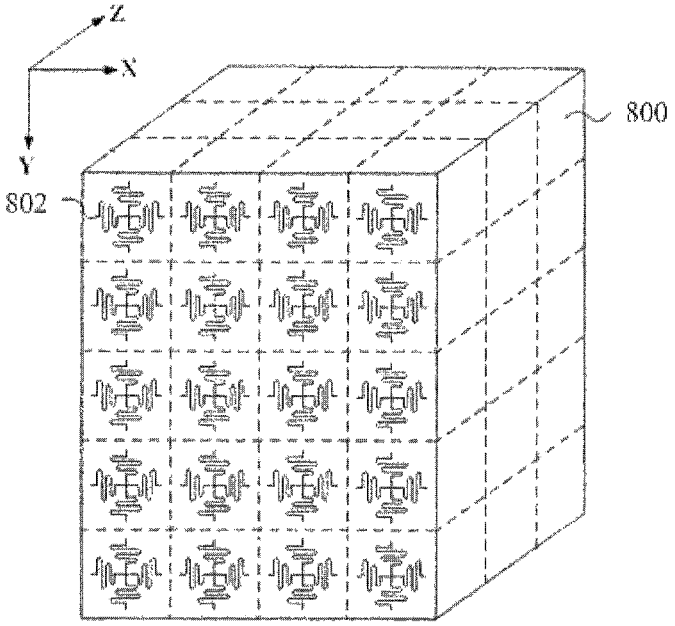
FIGS. 10-11 are schematic diagrams of an artificial electromagnetic material according to a eighth embodiment.
Figure 11:
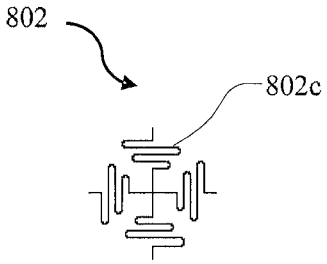

As shown in FIG. 10 and FIG. 11, the artificial electromagnetic material 800 in this embodiment differs from the artificial electromagnetic materials 600 shown in FIG. 6 and FIG. 7 in that each curve portion 802*c* of the circuitous curve of the artificial microstructure 802 is a round corner.

Figure 12:
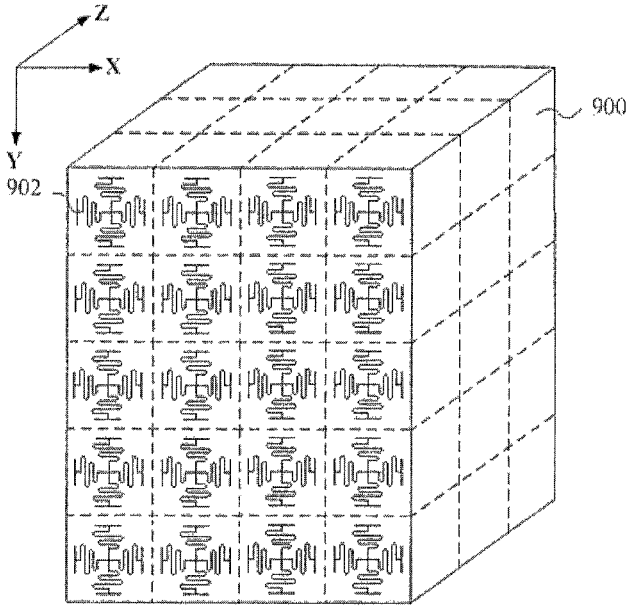
FIGS. 12-13 are schematic diagrams of an artificial electromagnetic material according to a ninth embodiment.
Figure 13:
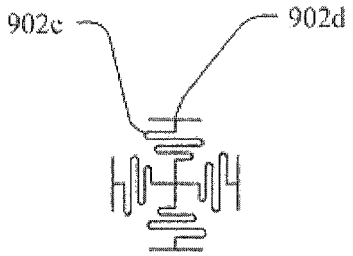

As shown in FIGS. 12 and 13, the artificial electromagnetic material 900 in this embodiment differs from the artificial electromagnetic materials 800 shown in FIG. 10 and FIG. 11 in that each curve portion 902*c* of the artificial microstructure 902 is connected to a third line segment 902*d*, and the curve portion 902*c* is connected to a middle of the third line segment 902*d*.

Figure 14:
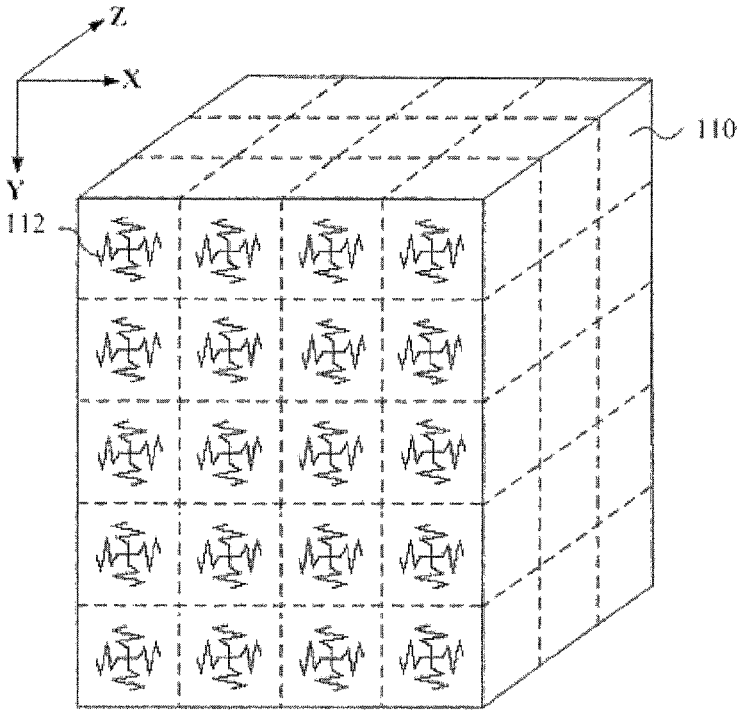
FIGS. 14-15 are schematic diagrams of an artificial electromagnetic material according to a tenth embodiment.
Figure 15:
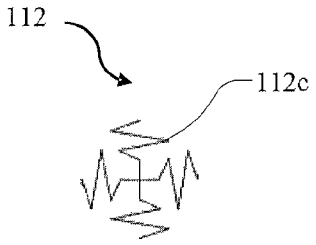

As shown in FIGS. 14 and 15, the artificial electromagnetic material 110 in this embodiment differs from the artificial electromagnetic materials 600 shown in FIG. 6 and FIG. 7 in that each curve portion 112*c* of the artificial microstructure 112 is a sharp corner.

Figure 16:
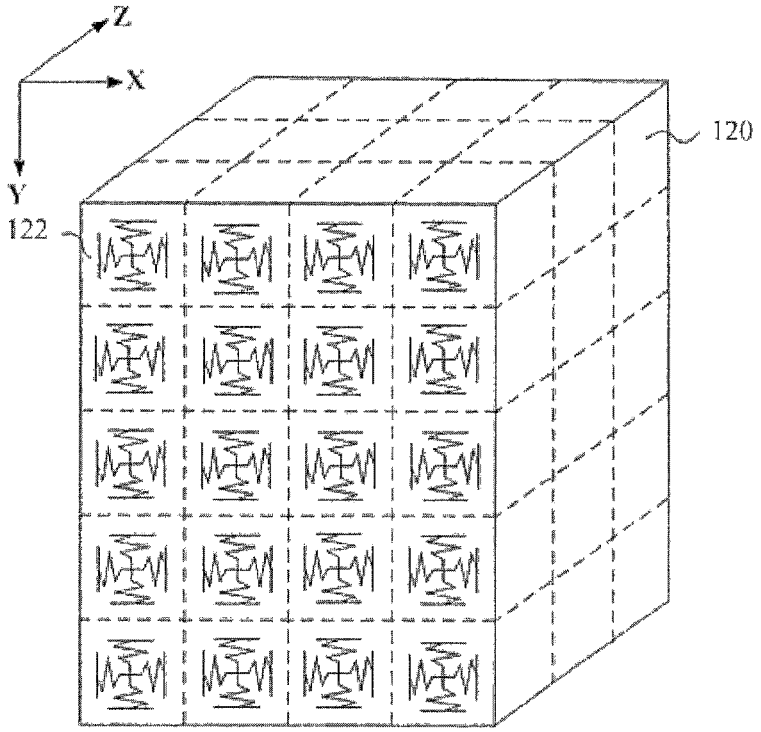
FIGS. 16-17 are schematic diagrams of an artificial electromagnetic material according to an eleventh embodiment.
Figure 17:
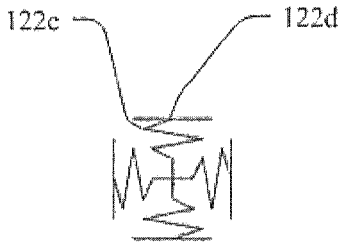

As shown in FIGS. 16 and 17, the artificial electromagnetic material 120 in this embodiment differs from the artificial electromagnetic material 110 shown in FIG. 14 and FIG. 15 in that each curve portion 122*c* of the artificial microstructure 122 is connected to a third line segment 122*d*, and the curve portion 122*c* is connected to a middle of the third line segment 122*d*.

In the embodiments as shown in FIGS. 6-17, by changing structure of each branch in the crossing shaped artificial microstructure and increasing the length of the metal line, dielectric constant of the isotropic metamaterial having such artificial microstructure in a very wide frequency is very stable in simulation result. In addition, comparing to metamaterial with crossing shaped artificial microstructure, dielectric constant and refractive index both apparently increase. When the microstructure is spatially symmetric and isotropic, responses of electromagnetic wave from the microstructure incident in different directions are same to each other. That is, the response values on X, Y and Z axis are same to each other. When the microstructure forms artificial electromagnetic material, if the artificial electromagnetic material has isotropic properties, the response value of the artificial electromagnetic material in X, Y and Z axis component are uniform. The isotropic metamaterial with high dielectric constant can be applied in the field of antenna manufacturing and semiconductor manufacturing, and as the technical solution overcomes dielectric constant limitation in per unit in existing technology, thus the technical solution has significant impact on miniaturization microwave devices.

Figure 18:
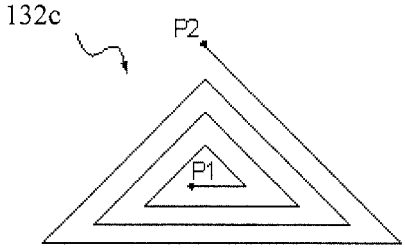
FIGS. 18-20 are schematic diagrams of an artificial electromagnetic material according to a twelfth embodiment.
Figure 19:
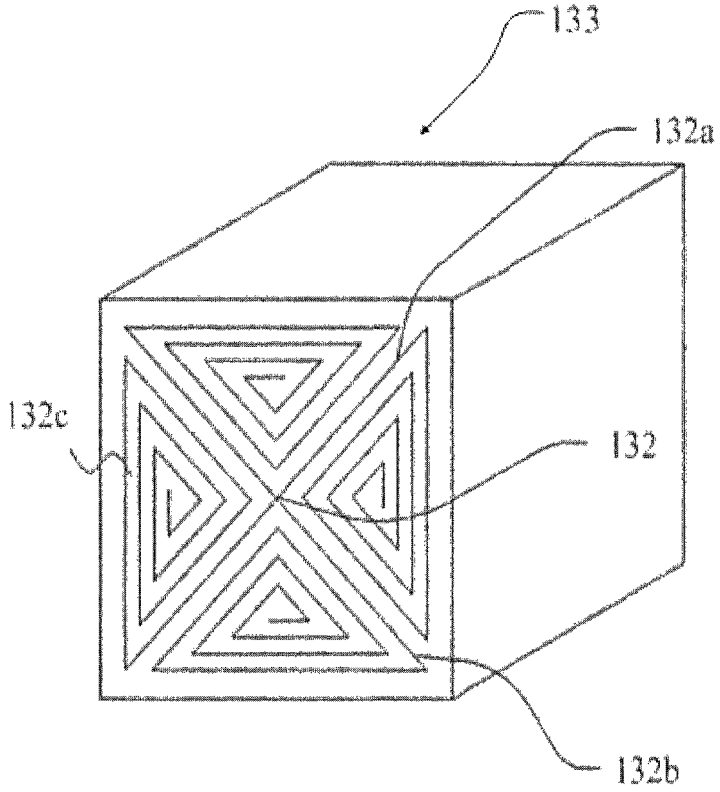
Figure 20:
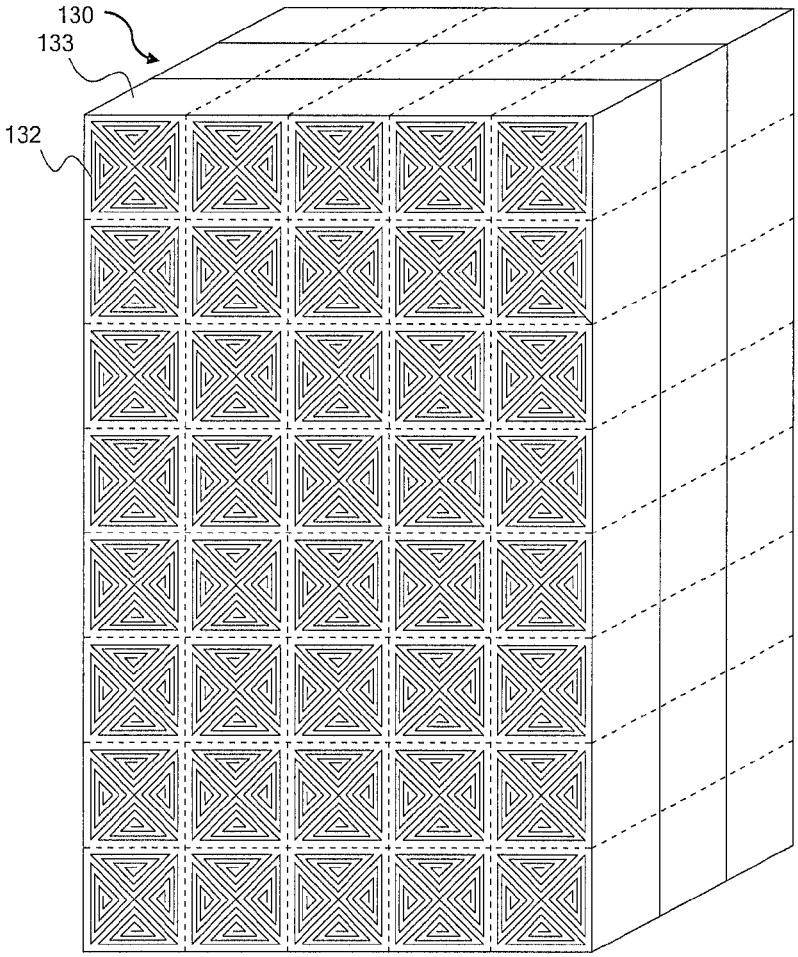

Referring from FIGS. 18 to 20, the artificial electromagnetic material 130 in this embodiment differs from the artificial electromagnetic material 600 shown in FIG. 6 and FIG. 7 in that the curve portion 132*c* of the artificial microstructure 132 is spiral. Two curve portions 132*c* located at a same imaginary line of the first line segment 132*a* or the second line segment 132*b* are symmetric relative to each other. The first line segment 132*a* and the second line segment 132*b* intersecting with each other to form four parts, each of the parts and a corresponding distal end there of form four spirals in a same structural manner. Each spiral extends outward from an inner endpoint P1 to the outer endpoint P2. The four spirals do not intersecting with each other and share a same outer endpoint P2. Each spiral coincides with a neighboring spiral if such spiral rotates 360/M degree about the outer endpoint P2, wherein M represents the number of spirals. In this embodiment, each spiral coincides with a neighboring spiral if such spiral rotate 360/4=90 degrees. An area of each spiral is one fourth of an area of the structural unit 133.

The spiral in this embodiment is a triangular spiral. In this embodiment, the triangular spiral is consisted of a number of lines connected with each other in sequence. The lines are divided into three groups. The lines in each group are parallel to each other. Three lines can be selected randomly from three groups respectively. The three lines extend and intersect with each other to form a triangular. Such spiral is a triangular spiral. In addition, the spiral in this embodiment is an isosceles triangle spiral, that is, the above mentioned three lines extend and intersect with each other to form an isosceles triangular.

Figure 21:
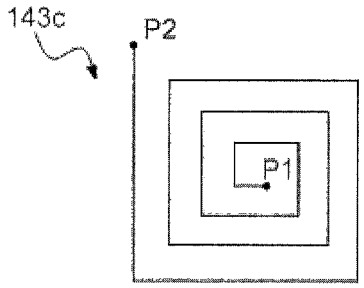
FIGS. 21-22 are schematic diagrams of an artificial electromagnetic material according to a thirteenth embodiment.
Figure 22:
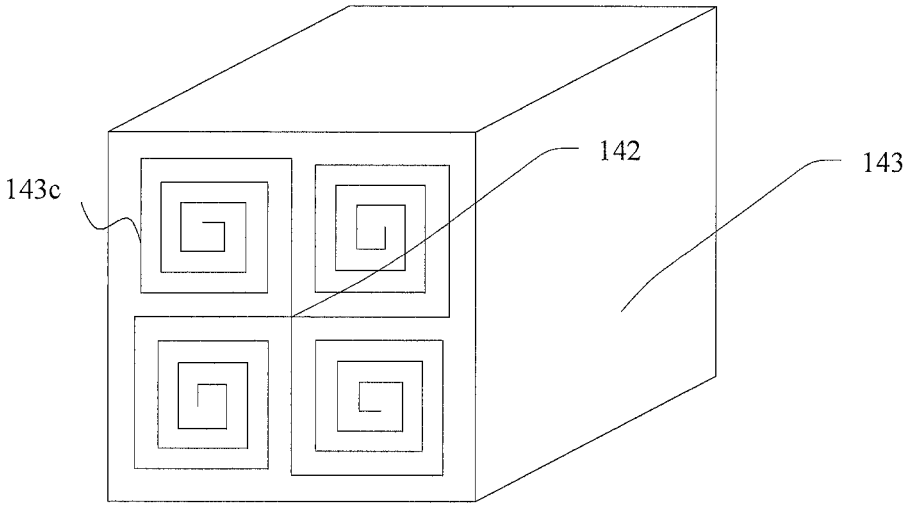

Referring from FIGS. 21 to 22, the structural unit 143 in this embodiment differs from the structural unit 133 shown in FIG. 18 and FIG. 19 in that the curve portion 142*c* of the artificial microstructure 142 is a rectangular spiral. The artificial microstructure 142 in this embodiment includes four spirals in a same structural manner. Similarly, the four different spirals each snaked extend outward from a corresponding inner endpoint P1 to the outer endpoint P2. The four different spirals share a same outer endpoint P2. Each spiral coincides with a neighboring spiral if such spiral rotate 360/4=90 degrees from the outer endpoint P2. An area of each spiral is one fourth of an area of the structural unit 143.

The spiral in this embodiment is a rectangular spiral. In this embodiment, the rectangular spiral is consisted of a number of lines connected with each other in sequence. The lines are divided into four groups. The lines in each group are parallel to each other. The four lines can be selected randomly from four groups respectively. The four lines each extend and intersect with a neighboring line to form a rectangular. Such spiral is a rectangular spiral.

Figure 23:
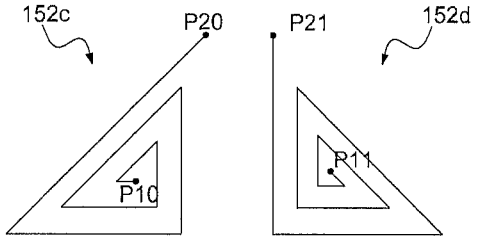
FIGS. 23-24 are schematic diagrams of an artificial electromagnetic material according to a fourteenth embodiment.
Figure 24:
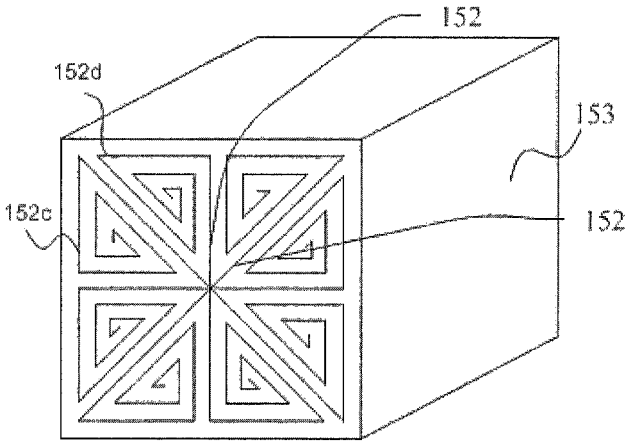

Referring from FIGS. 23 to 24, the structural unit 153 in this embodiment differs from the structural unit 143 shown in FIG. 18 and FIG. 19 in that the structural unit 153 includes two artificial microstructures 152. One of the artificial microstructures 152 includes four first spirals 152*c* in a same structural manner, and the other artificial microstructure 152 includes four different spirals 152*d*, wherein M=8. The first and the second spirals 152*c*, 152*d* each snaked extend outward clockwise from a corresponding inner endpoint P1 to the outer endpoints P20 and P21. The two outer endpoints P20, P21 are a same point. A linear structure consisted of a first spiral and a second spiral coincides with a neighboring linear structure if such linear structure rotates 90 degrees from the outer endpoint P20.

Each of the first spiral 152*c* and the second spiral 152*d* is an isosceles right triangle spiral. An area of the first spiral 152*c* or the second spiral 152*d* is one eighth of an area of the structural unit 153.

Figure 25:
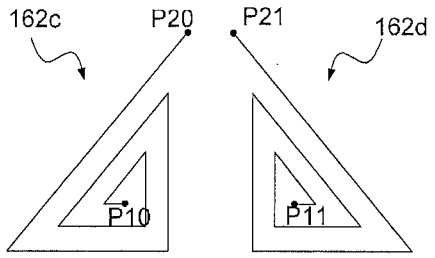
FIGS. 25-26 are schematic diagrams of an artificial electromagnetic material according to a fifteenth embodiment.
Figure 26:
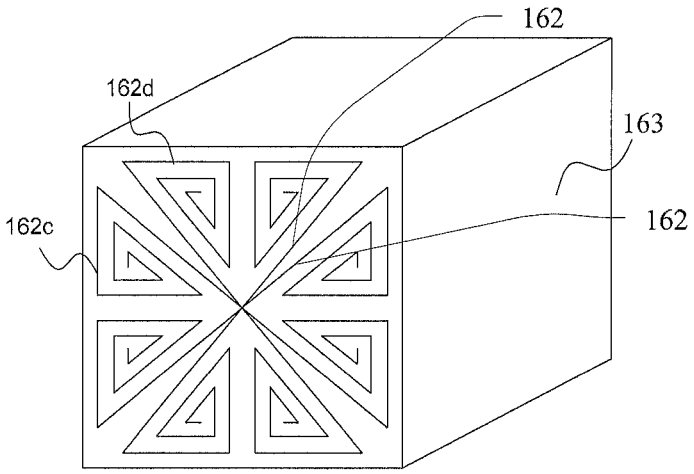

Referring also to FIGS. 25 to 26, the structural unit 143 in this embodiment differs from the structural unit 143 shown in FIG. 23 and FIG. 24 in that the two neighboring spirals are symmetric relative to each other.

The spiral 162*c*, 162*d* each are isosceles right triangle spiral, and snaked extend outward from an corresponding inner endpoints P10, P11 to the outer endpoints P20 and P21. An area of each spiral is one eighth of an area of the structural unit 163.

For any substrate unit with particular size, such substrate unit can snaked extends as much as possible on an surface area thereof. Comparing to the artificial microstructure made of traditional artificial electromagnetic material, the artificial microstructure in the present disclosure is much longer.

In existing technologies, each artificial microstructure can be equal to inductance, capacitance and resistance. By changing a length of the lines, an equivalent inductance can be changed accordingly. The opposite area of the bipolar plate of the capacitor is equal to the length between two adjacent lines relative to other multiplied by thickness of the lines. Therefore, for a specific structural unit, if other conditions are same, the equivalent inductance and the capacitance increase along with length of the artificial microstructure. Accordingly, dielectric constant of the material unit increases along with length of the artificial microstructure. In addition, the formula $n=\sqrt{\epsilon\mu}$ indicates that the refractive index n increases along with length of the artificial microstructure.

Preferably, the spiral of the artificial microstructure as shown in FIG. 22-26 is rather suitable to have a right angle, and the right angles are close to four edges of the surface of the structural unit, thus four corners on surface of the structural unit and the edge space can be fully utilized. Accordingly, the spirals can extend as long as possible, thereby increasing the refractive index. Artificial microstructure made of artificial electromagnetic material in the existing technology does not fully use the surface space of the structural unit, thus, the length of the line is much shorter than that in the present disclosure, and thus the refractive index is limited. The present disclosure obtains high dielectric constant and refractive index. Referring to the embodiments shown in FIGS. 18-20, when surface area of the substrate unit is 1.4 mm ••1.4 mm, and thickness of the substrate unit is 0.4 mm, and substrate material of the substrate unit is FR-4, distance from edges of the four sides of the artificial microstructure is 0.05 mm away from the surface of the substrate unit. When using copper wire line with line width of 0.1 mm for the artificial microstructure, trace spacing is about 0.1 mm. In addition, in 13 GHz frequency environment, refractive index of the artificial electromagnetic material in the present disclosure can be as high as 6.0.

Figure 27:
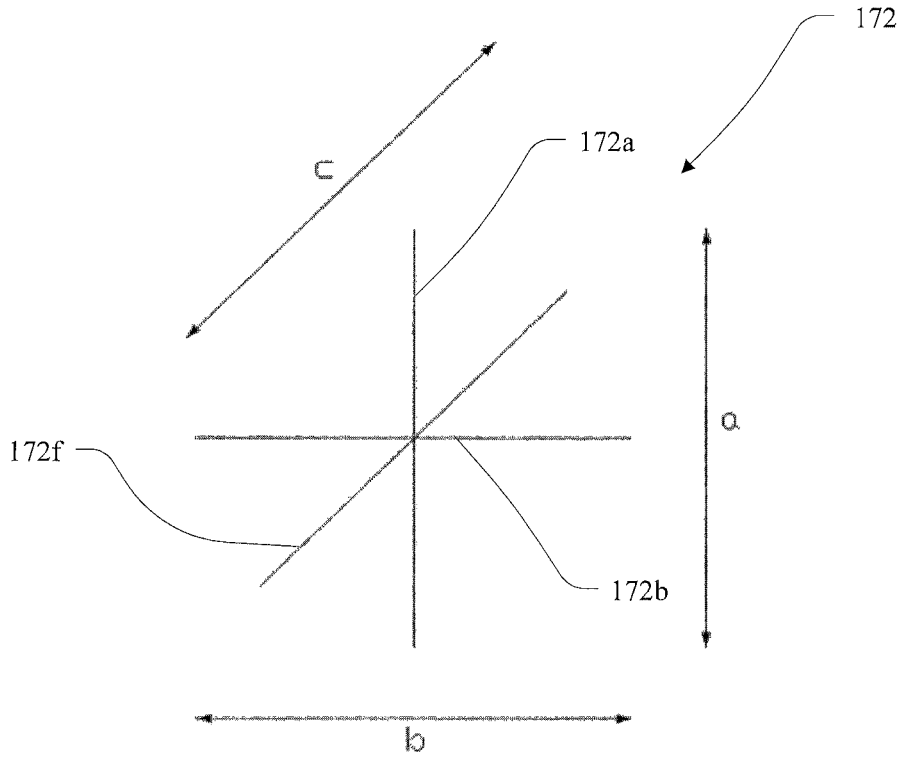
FIG. 27 is a schematic diagram of a sixteenth embodiment of an artificial electromagnetic material according to a sixteenth embodiment.

Referring to FIG. 27, a three-dimensional Cartesian coordinate system is shown in FIG. 27. The coordinate system includes three axes X, Y, and Z intersect with and perpendicular to each other. In this embodiment, the artificial microstructure 172 includes a first line segment 172*a* having length a in the X-axis, a second line segment 172*b* having length b in the Y-axis, and a sixth line segment 172*f* having length c in Z-axis. The midpoints of the first line segment 172*a*, the second line segment 172*b*, and the sixth line segment 172*f* are located at the three-dimensional coordinate system origin O (not shown). Accordingly, the first segment 172A, the second segment 172*b*, and the sixth line segment 172*f* compose the artificial microstructure 172. The lengths of a, b and c in one tenth of the wavelength λ or smaller is needed, such that space array of the artificial microstructures generates an effective response to electromagnetic waves with wavelength λ.

Figure 28:
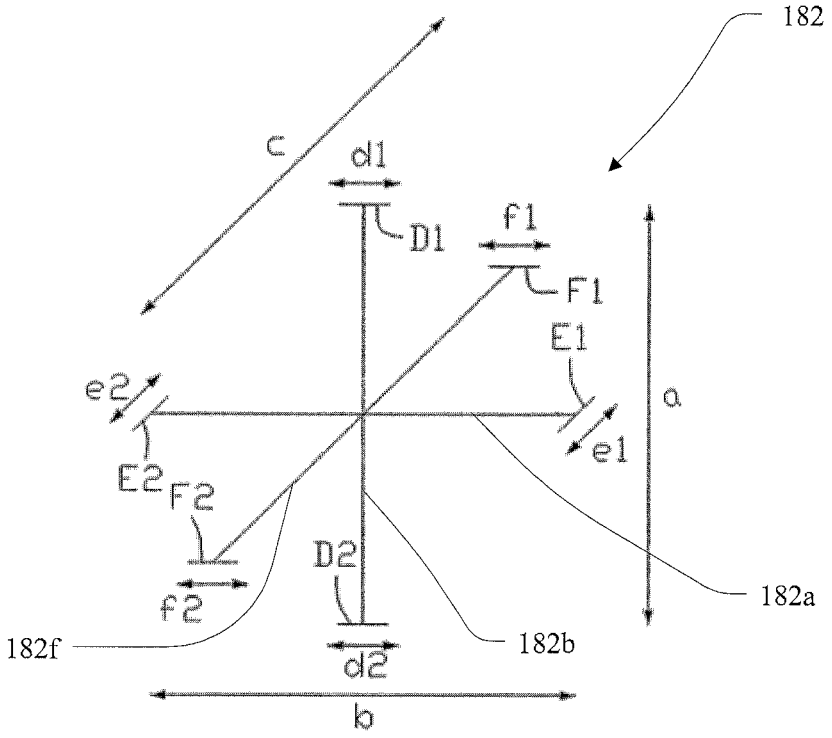
FIGS. 28-31 are schematic diagrams of an artificial electromagnetic material according to a seventeenth embodiment.

Referring to FIG. 28, an artificial microstructure 182 is similar to the artificial microstructure 172 in another embodiment. The artificial microstructure 182 differs from the artificial microstructure 172 in that the artificial microstructure 182 further includes a first line segment group. The first line segment group includes fourth line segments D1• Đ 2•Ɛ 1•Ɛ 2•F̶ 1•F̶ 2. Distal ends of the first line segment 182*a*, the second line segment 182*b*, and the sixth line segment 182*f* are connected to the fourth line segments D1• Đ 2•Ɛ 1•Ɛ 2•F̶ 1•F̶ 2. The fourth line segment is perpendicular to the line connected thereto. A fourth segment D1 with length d1 and a fourth segment D2 with length d2 are located at two distal ends of the first line segment 182*a*. A fourth segment E1 with length e1 and a fourth segment E2 with length e2 are located at two distal ends of the second line segment 182*b*. A fourth segment F1 with length f1 and a fourth segment F2 with length f2 are located at two distal ends of the sixth line segment 182*f*.

Figure 29:
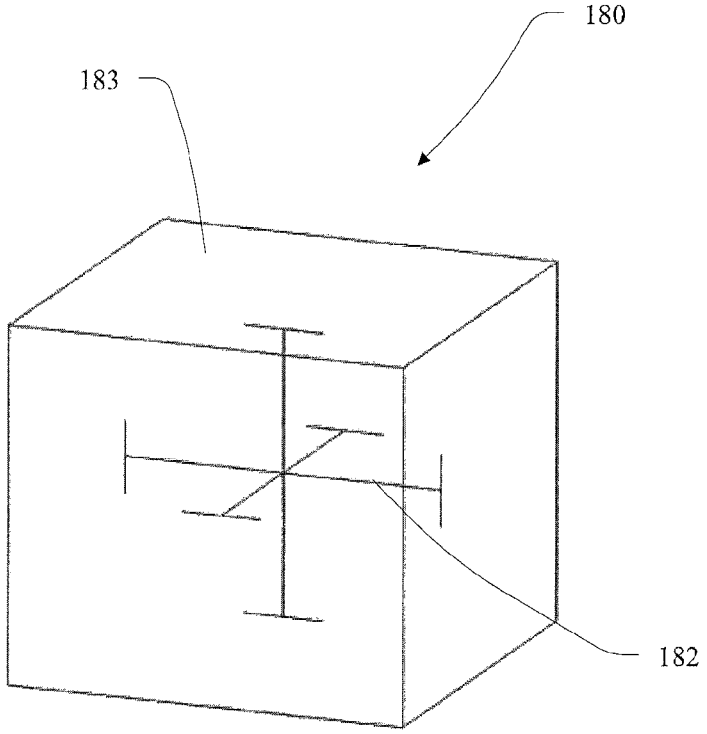
Figure 30:
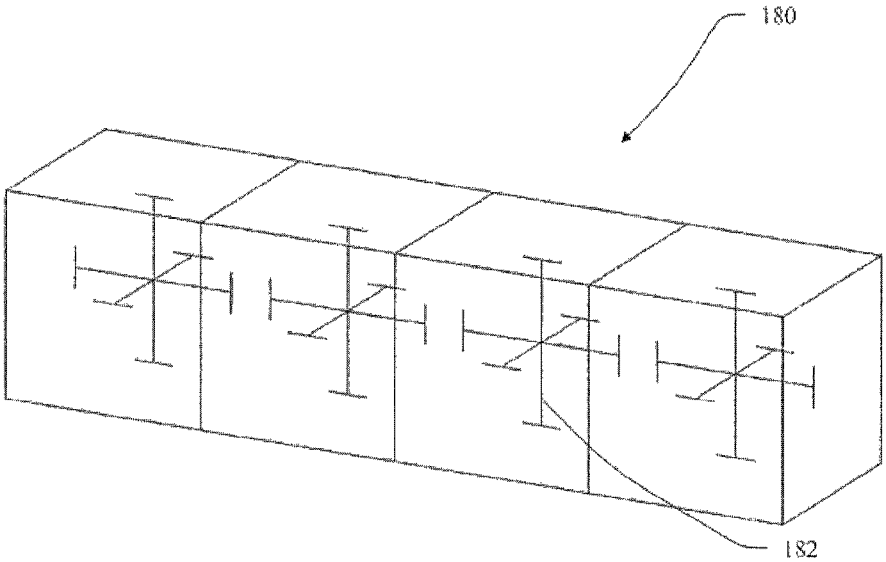
Figure 31:
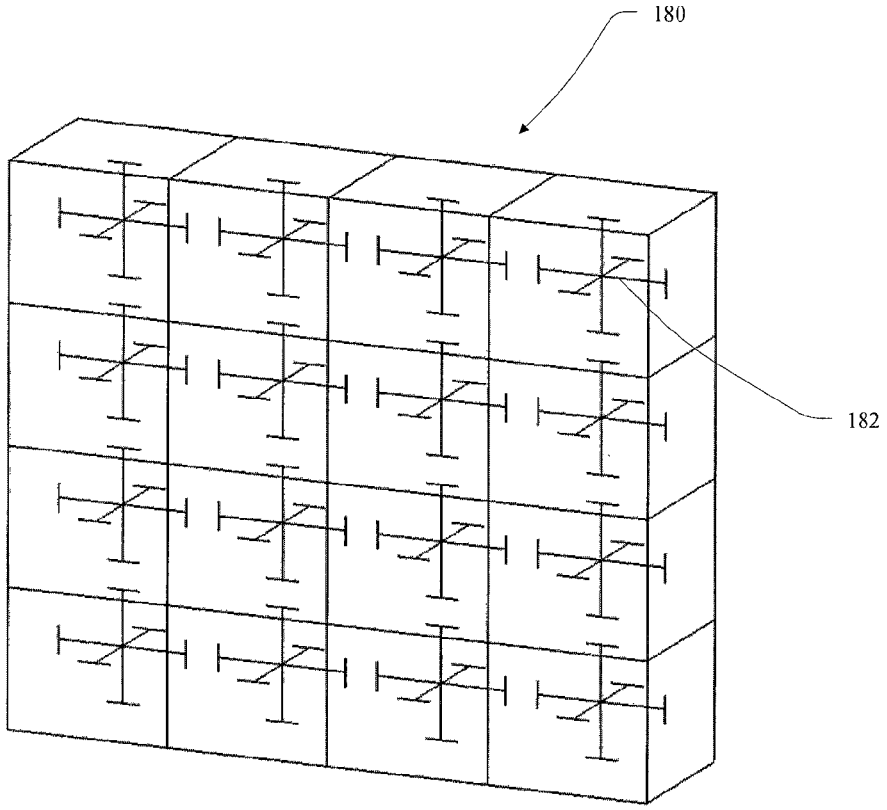

Referring to FIGS. 29-31, FIG. 29 is a schematic diagram of a structural unit 183 of the artificial electromagnetic material 180 of the artificial microstructure 182 in this disclosure. FIG. 30 is a one-dimensional structure diagram of the artificial electromagnetic material 180 of the artificial microstructure 182 in this disclosure. FIG. 30 is a 2D structure diagram of the artificial electromagnetic material 180 of the artificial microstructure 182 in this disclosure. It is to be understood that the artificial electromagnetic material 180 of the artificial microstructure 182 may has a 3-dimensional structure. The artificial electromagnetic material 180 with 3-dimensional structure can be achieved by stacking the artificial electromagnetic materials 180 with 2D structure.

Sizes of the above mentioned artificial microstructures 182 can be same to each other, and uniformly arranged on the substrate. In alternative embodiments, the sizes of the artificial microstructures 182 can be different from each other, and uniformly arranged on the substrate. In other alternative embodiments, the sizes of the artificial microstructures 182 can be same to each other, but unevenly arranged on the substrate. For example, density of the artificial microstructures 182 in one place can be greater while density of the artificial microstructures 182 in another place is less. In further other alternative embodiments, the sizes of the artificial microstructures 182 can be different from each other, and unevenly arranged on the substrate.

Figure 32:
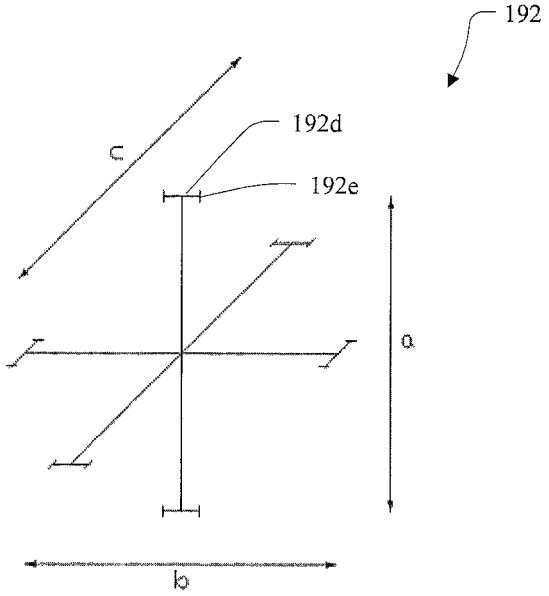
FIG. 32 is a schematic diagram of an eighteenth embodiment of an artificial electromagnetic material according to an eighteenth embodiment.

Referring to FIG. 32, an artificial microstructure 192 is similar to the artificial microstructure 182 in this embodiment. The artificial microstructure 192 differs from the artificial microstructure 182 in that the artificial microstructure 192 further includes a second line segment group. The second line segment group includes fifth line segments 192*e*. The fifth line segment 192*e* is connected to distal ends of the fourth line segment 192*d*. Each of the fifth line segments 192*e* is perpendicular to fourth line segment 192*d*.

In other embodiments, a number of third line segment group perpendicular to the fifth line segments 192*e* can be set at distal ends of the fifth line segments 192*e*, and a number of fourth line segment group perpendicular to the third line segments can be set at distal ends of the third line segments. Similarly, more topology structure can be derived therefrom, such structure is similar to the snowflake structure, and is derivative structure of the snowflake structure.

In the derivative structure based on the snowflake structure, length a of the first line segment 182*a*, length b of the second line segment 182*b*, and length c of the third line segment 182*a* are independent variables, and can be any length value. The single snowflake artificial structure show different property when different length value is selected. The lengths d1, d2, e1, e2, f1 and f2 corresponding to the fifth line segments D1, D2, E1, E2, F1, F2 can be any length value. In addition, the fifth line segments D1 and D2, E1 and E2, F1 and F2 can be spatially parallel to each other, or not spatially parallel to each other. Different property of the single snowflake artificial structure is determined by the lengths and location relationships of the fifth line segments.

Only when a, b and c are equal to each other, d1, d2, e1, e2, f1 and f2 accordingly are equal to each other, and the fifth line segments located on a same straight line are parallel to each other. The fifth line segments accordingly parallel to the sixth line segment. When the fifth line segment F1, F2 are parallel to the first line segment 182*a*, respectively, the single snowflake structure has a symmetric structure, and the structural unit with the snowflake structure therein shows isotropic property toward the electromagnetic wave. When the artificial microstructure includes N line segment groups, all the line segments in the Nth line segment group is parallel to each other, and have a same length. In addition, all the line segments in the Nth line segment group is parallel to any of the first line segment 182*a*, the second line segment 182*b*, and the sixth line segment 182*f*, if the derivative structure is needed to show isotropic property, otherwise the derivative structure show anisotropy property. In the present disclosure, isotropic property and anisotropy property can be achieved when necessary.

Artificial electromagnetic materials as shown in FIGS. 27-32 are modulated electromagnetic waves. The propagation of electromagnetic wave normally includes propagation of electric and propagation of magnetic field, and accordingly generates response in the propagation medium, which is expressed as dielectric constant $\xi$ and the magnetic permeability $\mu$. Dielectric constant $\xi$ and magnetic permeability rate of general dielectric material is approximately greater than zero. In the air the dielectric constant $\xi=1$, magnetic permeability $\mu=1$. As to a single snowflake artificial structure in the present disclosure, the dielectric constant $\xi<0$ and magnetic permeability $\mu<0$, that is to say, when the electromagnetic wave propagates and refracts in the artificial electromagnetic material, the incident light and refraction light is located at the same side of the incident plane normal.

By designing the structural arrangement of the artificial microstructure, and presetting electromagnetic properties of the artificial electromagnetic material in each three-dimensional coordinates of the space, the electromagnetic properties can be uniform rather than gradient. The electromagnetic properties can be otherwise uneven and gradient according to actual needs. In the present disclosure.

Dimension and arrangement structure of the artificial microstructure can be changed by designing, optimizing, and processing the artificial electromagnetic material, such that the dielectric constant $\xi$ and the magnetic permeability $\mu$ of the artificial electromagnetic material can be changed according b any preset value. In addition, propagation direction of the magnetic field also can be changed. In the present disclosure, the gradient, non-gradient property is referred to the gradient, non-gradient property of the dielectric constant $\xi$ and the magnetic permeability $\mu$. Propagation direction of the magnetic field and the dielectric constant $\xi$, as well as the magnetic permeability $\mu$ can be controlled by controlling the structure of the artificial electromagnetic material.

In addition to the above mentioned property, resonant frequency of artificial electromagnetic material can be tuned by changing the single snowflake artificial structure, the microstructure and implementation. That is, tuning of the resonant frequency of artificial electromagnetic material can be achieved by changing the material, a single microstructure, or material of the substrate.

Figure 33:
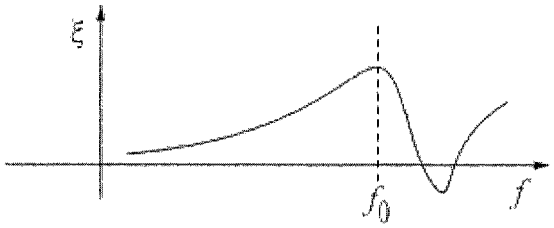
FIG. 33 is a schematic diagram of a graphic of $\xi$-f relation between dielectric constant $\xi$ of an artificial electromagnetic material and a magnetic permeability f in the present disclosure.
Figure 34:
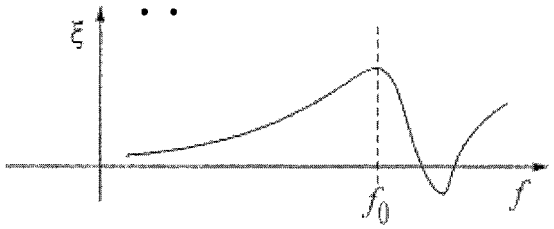
FIG. 34 is a schematic diagram of a graphic of $\mu$-f relation between a magnetic permeability $\mu$ of the artificial electromagnetic material and an electromagnetic wave frequency fin the present disclosure.

Referring to FIG. 33 and FIG. 34, FIG. 33 is a schematic graph illustrating relationship of dielectric constant $\xi$ and magnetic frequency $\mu$ of the artificial electromagnetic material in the present disclosure. FIG. 34 is a schematic graph illustrating relationship of dielectric constant $\xi$ and the magnetic permeability $\mu$ in the present disclosure, wherein f0 is resonant frequency. It is understood in existing technology that when response frequency f is near to resonant frequency f0 of the system, resonant loss is accordingly generated. The resonant loss is the largest one, and not only reduces the life of the system, but also affects the work efficiency. By using the above mentioned tuning method in the present disclosure, the artificial electromagnetic material is tuned by adjusting sum of the dielectric constant $\xi$ and magnetic permeability $\mu$ of the artificial electromagnetic materials, such that the resonant frequency f0 pan. Generally, the frequency f0 is relatively high, thus working frequency of the artificial electromagnetic material is far away from the resonant frequency. In the present disclosure, by changing the dielectric constant $\xi$ of the artificial microstructure, thus changing dielectric constant $\xi$ of the microstructure, and further changing sum of the dielectric constant and magnetic permeability $\mu$ of the artificial electromagnetic material, the working frequency of the artificial electromagnetic material is far away from the resonant frequency artificial electromagnetic material. Such that excessive loss is avoided. In addition of the above advantages, work of the artificial electromagnetic material can be efficiently predicted by Math, thus designing values of the dielectric constant of the artificial electromagnetic material and the magnetic permeability.

Figure 35:
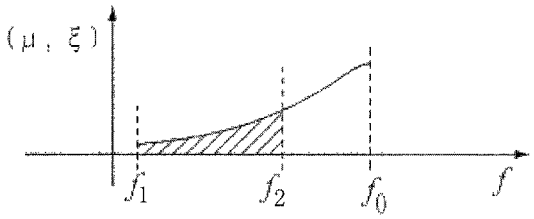
FIG. 35 is a schematic diagram of a working frequency of the artificial electromagnetic material in the present disclosure.

Referring to FIG. 35, FIG. 35 is a schematic graph illustrating working frequency of the present disclosure. By using tuning effect, artificial electromagnetic materials in the present disclosure further achieve scope of ultra-wideband working range. When the response frequency is away from resonant frequency, the range of the frequency response of the artificial electromagnetic materials is accordingly widened. Lower limit of the operating frequency is f1, and upper limit of the working frequency is f2. The work bandwidth value is (f1−f2). Comparing to existing magnetic materials, the operating frequency of the present disclosure is relatively great, belonging to the value of ultra-wideband.

When the electromagnetic wave incident from a direction perpendicular to the microstructure, the microstructure does not response to the magnetic fields. When the microstructure is spatial symmetric and has isotropic response, the microstructure have the same response toward the incident electromagnetic waves in all directions. That is, the microstructure has a same response value along the X, Y and Z axes. As mentioned above, when the microstructure form an artificial electromagnetic material, if the artificial electromagnetic materials has isotropic properties, response value of the artificial electromagnetic materials in the X, Y and Z axes component are uniform. On the contrary, if it is anisotropy, the response value is uneven distribution, resulting in convergence of electromagnetic waves, offset, etc. When the electromagnetic wave incident vertical to the artificial electromagnetic materials, and through the artificial electromagnetic materials, propagation direction of the electromagnetic wave is deflected according to the preset dielectric constant and magnetic permeability. Generally, the deflection is generated toward a direction of which the absolute value of the dielectric constant and magnetic permeability is great, thus achieving aggregation and offset of the electromagnetic wave. When the electromagnetic wave incident straightly into the artificial electromagnetic materials, and is emitted from the other direction parallel to the incident direction, the incident light and the emitted light are parallel to translation of the communication line horizontally shifted.

Artificial electromagnetic materials of the above embodiments are new material with special electromagnetic effects. The artificial electromagnetic materials can replace the existing magnetic material, and can be applied to a variety of applications. For example, the artificial electromagnetic materials can be applied to electromagnetic wave propagation modulation materials and devices, such as smart antenna, angle zoom, or the modulation of the waveguide system applied to the electromagnetic mode, functional polarization modulation devices, microwave circuit, THz (terahertz), and optical application.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An artificial microstructure used in artificial electromagnetic material, comprising a first line segment and a second line segment perpendicular to the first line segment, the first line segment and the second line segment intersecting with each other to form a cross-type structure; wherein a distal end of the first line segment and a distal end of the second line segment each comprises a bent portion, and the bent portion comprises at least one circuitous bent section, each bent portion is a right angle; the artificial microstructure further comprises a plurality of third line segments, the bent portion is connected to a middle of a corresponding third line segment.

2. The artificial microstructure of claim 1, wherein the first line segment and the second line segment intersect with each other to form four parts, each of the parts and a corresponding bent portion thereof form a spiral.

3. The artificial microstructure of claim 2, wherein two bent portions located at a same imaginary line of the first line segment or the second line segment are symmetric relative to each other.

4. The artificial microstructure of claim 2, wherein the first line segments and the second line segments of a plurality of artificial microstructures intersect with each other at an imaginary central point.

5. The artificial microstructure of claim 4, wherein each bent portion coincides with a neighboring bent portion if such bent portion rotate 360/M degrees about an imaginary point intersected by the first line segment and the segment and served as a rotation center, wherein M represents the number of bent portion.

6. The artificial microstructure of claim 1, wherein the artificial microstructure comprises a sixth line segment, the sixth line segment is perpendicular to the first line segment and the second line segment, and the sixth line segment, the first line segment and the second line segment interest at a point.

7. The artificial microstructure of claim 6, wherein a distal end of the first line segment and a distal end of the second line segment each are respectively connected to the third line segments.

8. The artificial microstructure of claim 7, wherein the artificial microstructure comprises a line segment group, the line segment group comprises a plurality of fourth line segments, each of the third segments has a fourth line segment vertically connected to both ends thereof.

9. The artificial microstructure of claim 8, wherein the artificial microstructure comprises N line segment groups, each line segment of the N segment group is connected to a distal end of the line segment of the N−1 line segment group, and is perpendicular to the line segment of the N−1 segment group, wherein N represents an integer greater than 1.

10. The artificial microstructure of claim 8, wherein the artificial microstructure are mirror images of each other along an imaginary center axis.

11. An artificial electromagnetic material, comprising:

a substrate, the substrate comprising a plurality of structural units;

a plurality of artificial microstructures arranged in the respective structural units, each artificial microstructure comprising a first line segment and a second line segment perpendicular to the first line segment, the first line segment and the second line segment intersecting with each other to form a cross-type structure; wherein a distal end of the first line segment and a distal end of the second line segment each comprises a bent portion, and the bent portion comprises at least one circuitous bent section, each bent portion is a right angle; the artificial microstructure further comprises a plurality of third line segments, the bent portion is connected to a middle of a corresponding third line segment.

12. The artificial electromagnetic material of claim 11, wherein a size of the structural unit equal to or less than one tenth of the wavelength of the response electromagnetic wave.

13. The artificial electromagnetic material of claim 11, wherein the first line segment and the second line segment intersect with each other to form four parts, each of the parts and a corresponding bent portion thereof form a spiral.

14. The artificial electromagnetic material of claim 13, wherein two bent portions located at a same imaginary line of the first line segment or the second line segment are symmetric relative to each other.

15. The artificial electromagnetic material of claim 13, wherein the first line segments and the second line segments of a plurality of artificial microstructures intersect with each other at an imaginary central point.

16. The artificial electromagnetic material of claim 15, wherein each bent portion coincides with a neighboring bent portion if such bent portion rotate 360/M degrees about an imaginary point intersected by the first line segment and the segment and served as a rotation center, wherein M represents the number of bent portion.

17. The artificial electromagnetic material of claim 11, wherein the artificial microstructure comprises a sixth line segment, the sixth line segment is perpendicular to the first line segment and the second line segment, and the sixth line segment, the first line segment and the second line segment interest at a point.

18. The artificial electromagnetic material of claim 17, wherein a distal end of the first line segment and a distal end of the second line segment each are respectively connected to the third line segments.

19. The artificial electromagnetic material of claim 18, wherein the artificial microstructure comprises a line segment group, the line segment group comprises a plurality of fourth line segments, each of the third segments has a fourth line segment vertically connected to both ends thereof.

20. The artificial electromagnetic material of claim 19, wherein the artificial microstructure comprises N line segment groups, each line segment of the N segment group is connected to a distal end of the line segment of the N−1 line segment group, and is perpendicular to the line segment of the N−1 segment group, wherein N represents an integer greater than 1.

21. The artificial electromagnetic material of claim 19, wherein the artificial microstructure are mirror images of each other along an imaginary center axis.

* * * * *